US009969465B2

(12) United States Patent
Tingey

(10) Patent No.: US 9,969,465 B2
(45) Date of Patent: May 15, 2018

(54) KNEE BRACES FOR BOATS

(71) Applicant: ALPACKA RAFT LLC., Mancos, CO (US)

(72) Inventor: Sheri Lynn Tingey, Mancos, CO (US)

(73) Assignee: Alpacka Raft LLC, Mancos, CO (US)

( * ) Notice: Subject to any disclaimer, the term of this patent is extended or adjusted under 35 U.S.C. 154(b) by 0 days. days.

(21) Appl. No.: 15/792,915

(22) Filed: Oct. 25, 2017

(65) Prior Publication Data

US 2018/0043970 A1 Feb. 15, 2018

Related U.S. Application Data

(63) Continuation of application No. 15/454,772, filed on Mar. 9, 2017, now Pat. No. 9,834,281, which is a continuation of application No. 14/832,546, filed on Aug. 21, 2015, now Pat. No. 9,616,976.

(51) Int. Cl.

| | |
|---|---|
| ***B63B 35/71*** | (2006.01) |
| ***B63B 7/08*** | (2006.01) |
| ***B63B 17/00*** | (2006.01) |

(52) U.S. Cl.

CPC ..... *B63B 7/085* (2013.01); *B63B 17/00* (2013.01)

(58) Field of Classification Search

CPC ..... B63B 35/71

USPC ..... 114/347, 363

See application file for complete search history.

(56) References Cited

U.S. PATENT DOCUMENTS

| | | | | |
|---|---|---|---|---|
| 3,769,645 | A * | 11/1973 | Lettman | B63B 29/00 114/363 |
| 4,031,580 | A * | 6/1977 | Neumann | B63B 7/08 114/345 |
| 4,106,143 | A | 8/1978 | Lucas | |
| 4,589,365 | A * | 5/1986 | Masters | B63B 35/71 114/347 |
| 4,669,992 | A * | 6/1987 | Morris | B63B 35/81 114/363 |
| 5,257,590 | A * | 11/1993 | Foote, Jr. | B63B 35/71 114/343 |
| 5,299,524 | A | 4/1994 | Szilagyi | |
| 5,417,179 | A * | 5/1995 | Niemier | B63B 35/71 114/347 |
| 5,493,982 | A * | 2/1996 | Carpenter | B63B 35/71 114/347 |
| 5,560,041 | A | 10/1996 | Walker | |
| 6,644,233 | B2 * | 11/2003 | Batt | B63B 35/71 114/347 |
| 6,874,442 | B1 * | 4/2005 | McDonough | B63B 35/71 114/347 |

(Continued)

OTHER PUBLICATIONS

International Patent Application No. PCT/US2016/047743, International Search Report and Written Opinion dated Nov. 10, 2016.

*Primary Examiner* — Lars A Olson
*Assistant Examiner* — Jovon Hayes
(74) *Attorney, Agent, or Firm* — Leber IP Law; Celia H. Leber

(57) ABSTRACT

The present disclosure relates generally to knee braces for boats. The knee braces described herein are particularly suitable for use with lightweight, inflatable rafts and kayaks, for example packrafts used in backcountry boating. The knee braces include a fabric body and a plurality of adjustable straps configured to attach the fabric body to a side wall of the boat.

6 Claims, 15 Drawing Sheets

(56) References Cited

U.S. PATENT DOCUMENTS

| | | | | |
|---|---|---|---|---|
| 6,990,920 | B2 * | 1/2006 | Hamilton | B63B 29/04 114/347 |
| 9,051,029 | B2 * | 6/2015 | Hays, III | B63B 29/04 |
| 9,616,976 | B2 | 3/2017 | Tingey | |

* cited by examiner

KNEE BRACES FOR BOATS

RELATED APPLICATION

This application is a continuation application of U.S. patent application Ser. No. 15/454,772, filed Mar. 9, 2017, which is a continuation of U.S. patent application Ser. No. 14/832,546, filed Aug. 21, 2015, the entire contents of which is hereby incorporated by reference.

BACKGROUND

Boats for use in navigating whitewater, e.g., whitewater kayaks, canoes and rafts, are typically outfitted with some type of knee brace, to allow the paddler to use his or her leg strength and body weight to help maneuver the boat.

In some cases, for example in open cockpit kayaks, the brace may take the form of a thigh strap, for example as disclosed in U.S. Pat. No. 5,493,982. Thigh straps provide some control of the craft, but control can be limited because force is applied predominately by the user's thigh and shin.

Hard shell boats, e.g., molded plastic and fiberglass whitewater kayaks, often have rigid, molded "hard shell" knee braces, which in some cases are lined with foam for comfort and to provide some conformability to the user's leg shape. Knee braces of this type generally provide good control of the boat, but may lack adjustability and generally cannot be used with inflatable boats. In particular, such braces are not suitable for use with lightweight inflatable boats, such as packrafts designed for backcountry use.

SUMMARY

The present disclosure relates generally to knee braces for boats. The knee braces described herein are particularly suitable for use with lightweight, inflatable rafts and kayaks, for example packrafts used in backcountry boating. The knee braces may be used, for example, in whitewater boating, as well as other applications such as sea-kayaking or expedition use.

In one aspect, the disclosure features a knee brace for a watercraft, the knee brace comprising: (a) a fabric body, (b) four attachment points, each attachment point comprising a strap having a fixed end attached to the fabric body, a standing portion configured to be attached to a side wall of the watercraft, and a free end, and (c) an adjustment buckle disposed on each of the straps and configured to allow adjustment of the length of the free end of the strap.

Some implementations may include one or more of the following features. The straps may be configured to allow the user to apply a pulling along the midline of the user's knee during use of the boat. The straps may be configured to allow the user to pull the free ends of the straps toward his or her torso when tightening the straps. In some cases, the adjustment buckles are configured to allow one-handed loosening of the straps.

The knee brace may further include one or more fasteners configured to releasably attach the standing portions of one or more of the straps to the side wall. At least one of the fasteners may include a portion of a quick release buckle.

The straps may be formed of webbing. The fabric body may include a stretch material, configured to be positioned over the user's kneecap during use. In some implementations, the fabric body also includes a substantially non-elastic material disposed along an inner edge of the fabric body to provide stiffness to the fabric body. The fabric body may also include a pre-tensioned ribbon tape along an inner edge of the fabric body.

In another aspect, the disclosure features an inflatable boat comprising: (a) a boat body having a side wall, and (b) a knee brace comprising (i) a fabric body, and (ii) four attachment points securing the knee brace to the side wall, each attachment point comprising a strap having a fixed end attached to the fabric body, a standing portion configured to be attached to the side wall, and a free end.

Some implementations of this aspect of the disclosure may include any of the features discussed above. Implementations may also include one or more of the following features.

The side wall may include attachment locations to which the attachment points are secured. For example, the side wall may include an array of attachment loops to which one of the attachment points can be secured, allowing the user to choose one of the loops to adjust the fit of the knee brace. In some cases, two of the attachment locations are configured to receive ends of a rod from which two of the straps can be suspended when the knee brace is mounted on the boat.

In yet another aspect, the disclosure features a method of releasably attaching a fabric knee brace to an inflatable boat. The method includes securing the knee brace to the side wall using four releasable attachment points, each attachment point comprising a strap having a fixed end attached to the fabric body, a standing portion configured to be attached to the side wall, and a free end.

In some implementations, securing comprises releasably attaching a rod to the side wall by positioning ends of the rod in receiving pockets on the side wall, and suspending two of the straps from the rod. Securing may also include releasably attaching a clip on one of the straps to one of an array of attachment loops on the side wall, and/or securing one of the straps to the side wall using a quick release buckle.

The knee braces described herein provide control and steering similar to what is provided by a rigid knee brace, while still being packable with an inflatable boat. The knee braces are highly adjustable, providing good leg support and enhancing user comfort. The design of preferred knee braces allows the user to pull along the midpoint of the knee, maximizing the torque that can be applied to the boat and providing excellent control of the tip of the boat in waves. These features may allow a user to use the knee braces to Eskimo roll the boat, even in the case of a flat-bottomed raft, a craft that is notoriously difficult to Eskimo roll. In preferred implementations, the knee brace defines an enclosed cup that minimizes risk of entanglement in the event of the boat capsizing or deflating.

DETAILED DESCRIPTION

Figure 1:
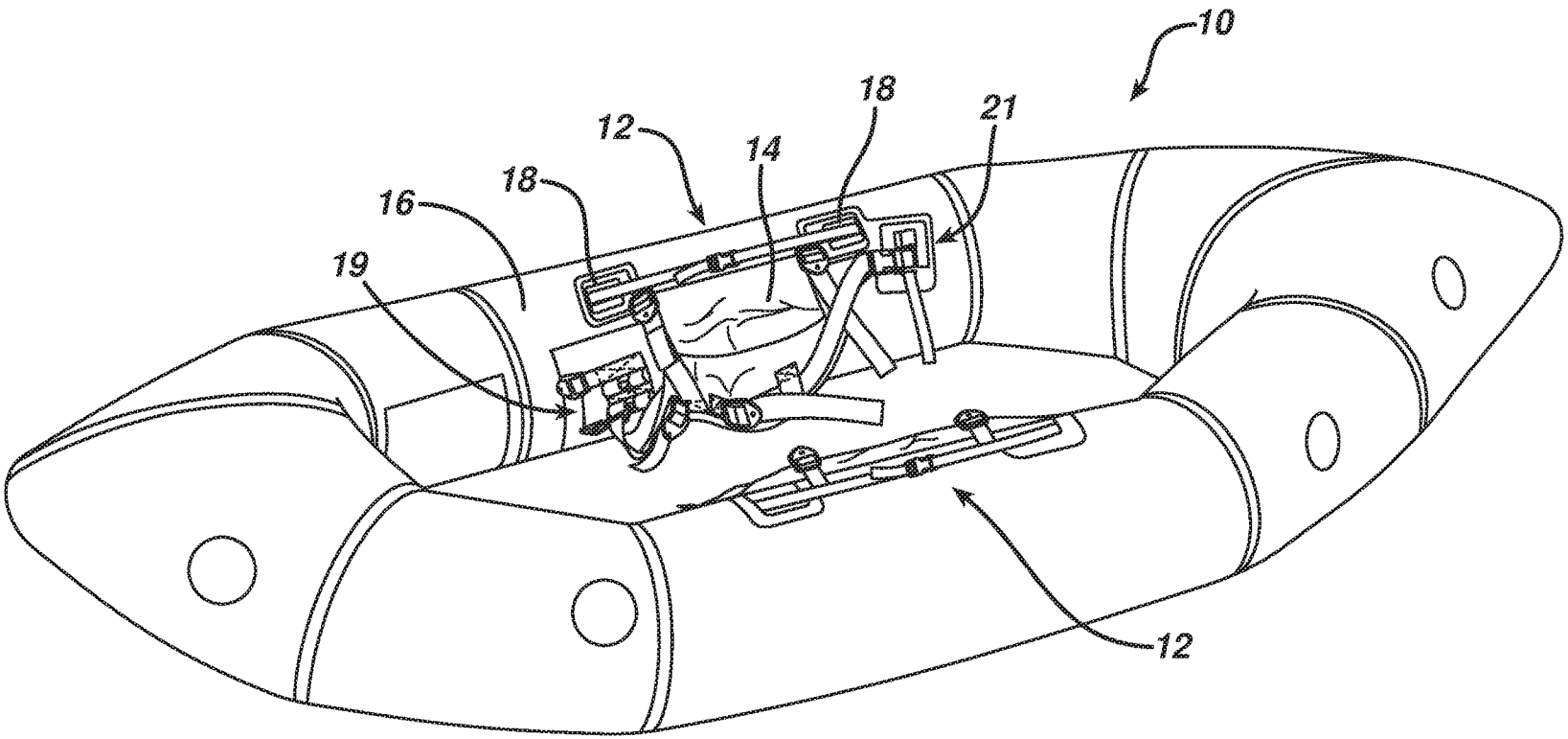
FIG. 1 is a perspective view of a packraft including knee braces according to one implementation. Certain elements of the packraft are omitted for clarity.

A packraft 10 including a pair of knee braces 12 is shown in FIG. 1. Typically, the packraft would also include other components to support the user, for example a seat, hip pads, foot braces, and other components well known in the raft and kayak art. These components have been omitted for clarity.

Each knee brace 12 includes a fabric body 14 and a plurality of adjustment and attachment straps, which will be described in detail below. Importantly, the straps provide four points of adjustable attachment of the knee brace around the user's knee. This arrangement has been found to provide the best balance of control of the boat with ease of use, user comfort and safety.

Figure 8:
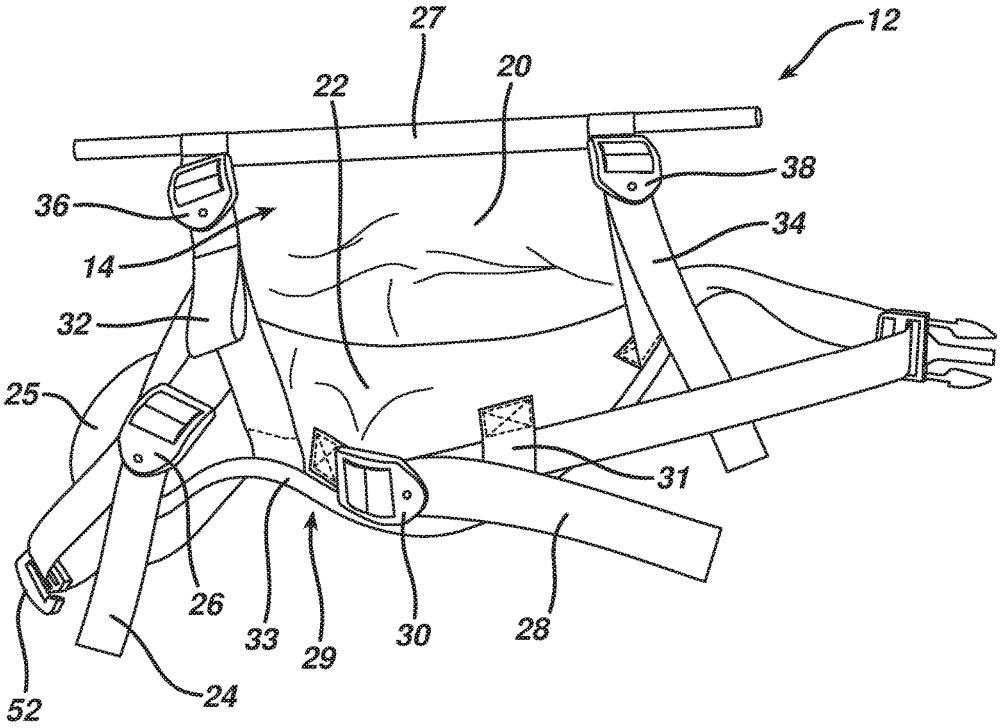
FIG. 8 is perspective view of the knee brace shown in FIG. 1.

As shown in FIG. 8, the fabric body includes an elastic portion 20 and a non-elastic portion 22. The elastic portion 20 provides a comfortable, secure pocket for the knee, and its presence prevents entrapment if the raft were to deflate or capsize. The user will tend to drive his or her knee up into the stretch material during use, and the elasticity of the material advantageously allows it to form around the user's knee under these conditions. This application of upward pressure is similar to the feeling a user has when pushing against a hard shell knee brace. The lack of any straps extending over the knee facilitates this upward movement. Elastic portion 22 may be formed, for example, from four-way stretch woven nylon, or other stretch dry suit materials such as heavy duty LYCRA® fabric.

The non-elastic portion 22 provides a strong, stiff area for attachment of the adjustment straps, and gives the user a stiff strap with which to apply force to the raft. The non-elastic portion may be formed, for example, of heavy pack cloth or other stiff, tightly woven material. Preferably, the non-elastic portion 22 is configured so that the grain of the fabric is substantially perpendicular to the length of the user's leg, and the edge 29 is curved in a manner so that tensile forces applied to the brace during use are applied along the grain of the fabric rather than on the diagonal.

For optimal stiffness of the non-elastic portion 22, it is preferred that the edge 29 be reinforced with a ribbon tape 33. This also provides reinforcement to the attachment points of straps 32 and 34, discussed below, as these straps can be stitched to the fabric body under or with the ribbon tape as well as with additional stitching inboard of the tape. The ribbon tape may be formed, for example, from nylon webbing, and is preferably held under tension as it is being applied to the edge. This pre-tensioned ribbon tape provides the non-elastic portion 22 with a hard edge that exhibits substantially no stretch under normal use conditions.

The elastic portion 20 and/or the non-elastic portion 22 may include sewn darts or the like to provide more fullness in the fabric portion in the area where the user's kneecap will be positioned.

In the implementation shown in FIG. 1, each knee brace is removably attached to the side wall 16 of the raft with an attachment system that will be described below with reference to FIGS. 8-15. Removable attachment of the knee braces can make the raft easier to pack, and makes the braces replaceable if damaged. However, in some implementations the knee braces may be permanently attached to the raft, for example if a very lightweight, custom-fitted boat is desired. In either case the preferred positioning of the attachment points will be substantially the same.

Figure 15:
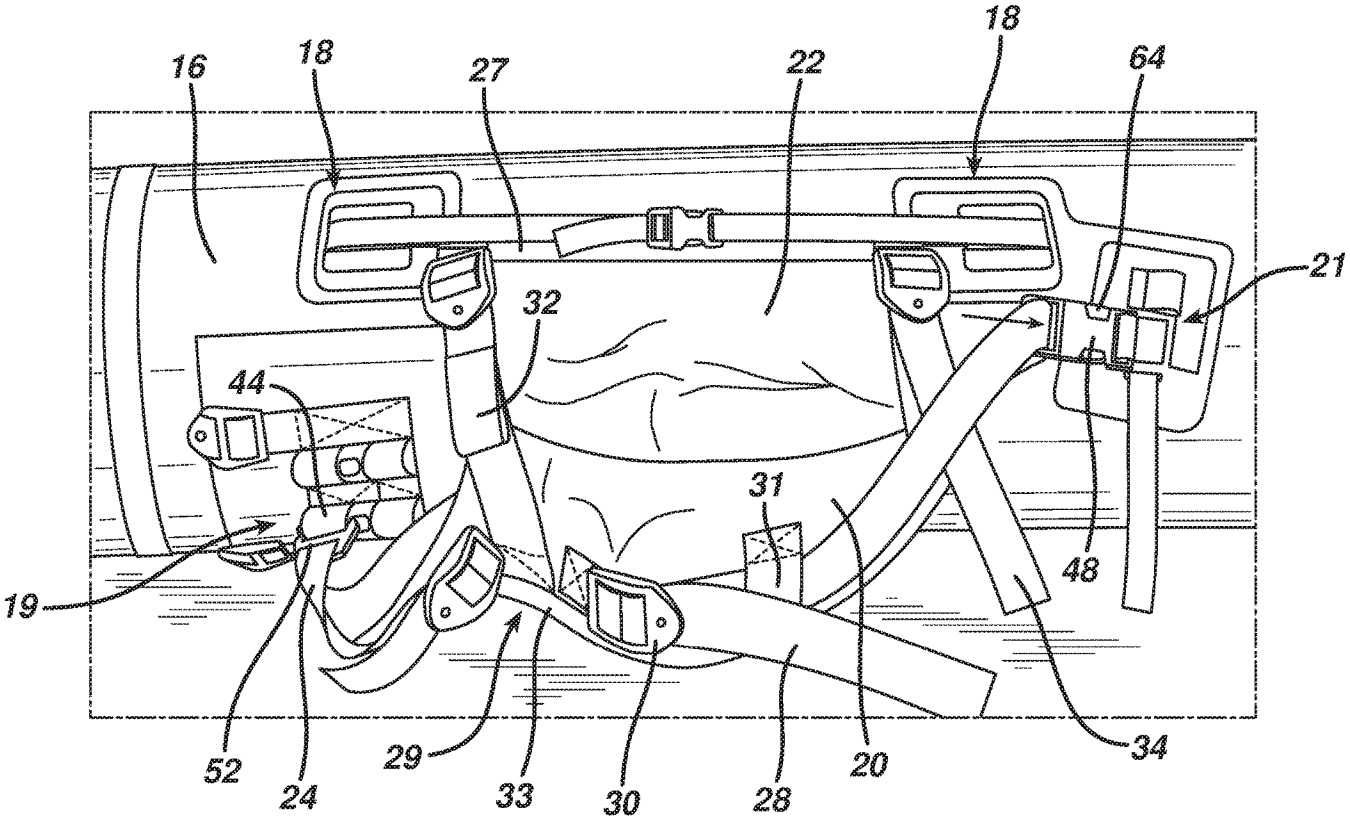

As shown in FIG. 1, the knee brace is attached to the side wall 16 at two upper attachment points 18, a forward attachment point 19, and a rearward attachment point 21. Referring to FIGS. 8 and 15, a pair of side straps 32, 34 extend from the upper attachment points 18 (attached to a rod 27 that extends between the attachment points, as will be described further below) to edge 29 of the non-elastic portion 22 of fabric body 14. A shin strap 24 extends between the forward attachment point 19 and an attachment point on a forward portion of the non-elastic portion 22, with an underlying flap 25 (FIG. 8) protecting the user's shin. A central strap 28 extends from an attachment point in a central portion of the non-elastic portion 22, adjacent edge 29, to rearward attachment point 21, with a curved portion of edge 29 extending under the strap to protect the user's skin. Together, the side straps, shin strap, and central strap provide the four points of adjustable attachment discussed above.

Strap 32 is preferably attached to edge 29 by first stitching the strap edge in line with the edge 29, for secure attachment, and then applying another, inboard, line of stitching at an angle, as shown in FIG. 15, so that the strap angles up and out so as to contour to the user's knee during use.

Central strap 28 is threaded through a retainer loop 31 (a short length of webbing secured at both ends to the fabric body) and then through a buckle 30 in a manner such that the tail of the central strap is positioned to be pulled toward the user. The other straps can also be adjusted without the user having to pull away from his or her torso. This arrangement facilitates adjustment of the strap from a seated position in the raft, which is particularly advantageous for "on the fly" adjustments when the raft is on the water.

As shown in FIG. 15, the standing portion of strap 28, extending between the buckle 30 and the attachment point 21, is doubled. This arrangement provides leverage when tightening the strap, and the tendency of the doubled portion to spread apart during use enhances the security of the attachment of the knee brace to the user's leg.

A preferred sequence of adjusting the straps will now be discussed, with reference to FIGS. 2-7.

Figure 2:
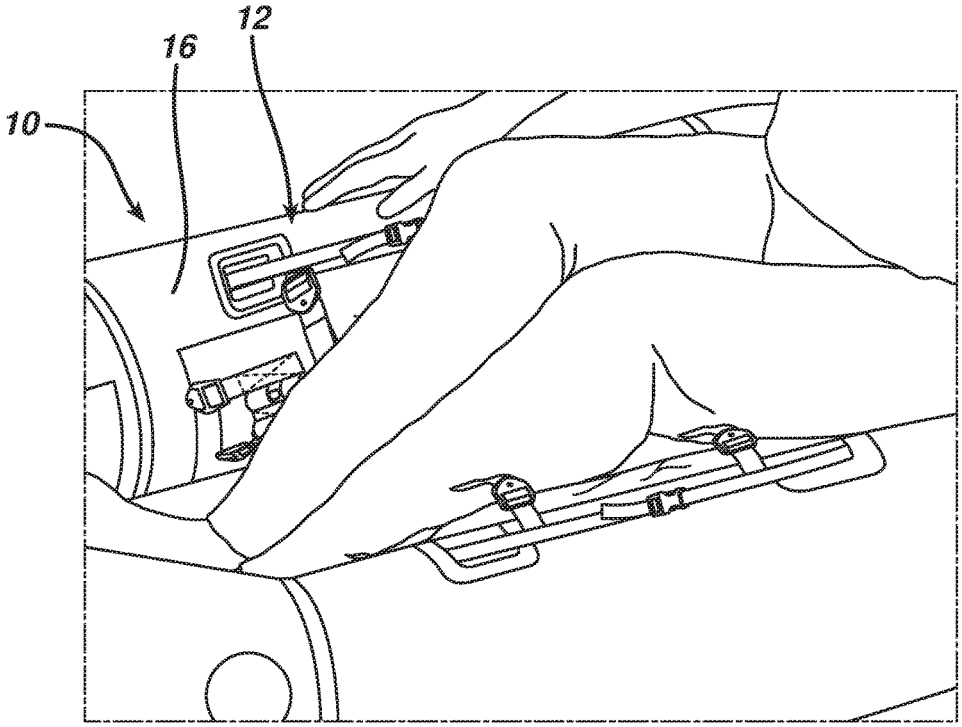
FIGS. 2-7 are detailed perspective views showing steps of applying the knee brace shown in FIG. 1 to a user's leg and adjusting the straps of the knee brace.
Figure 3:
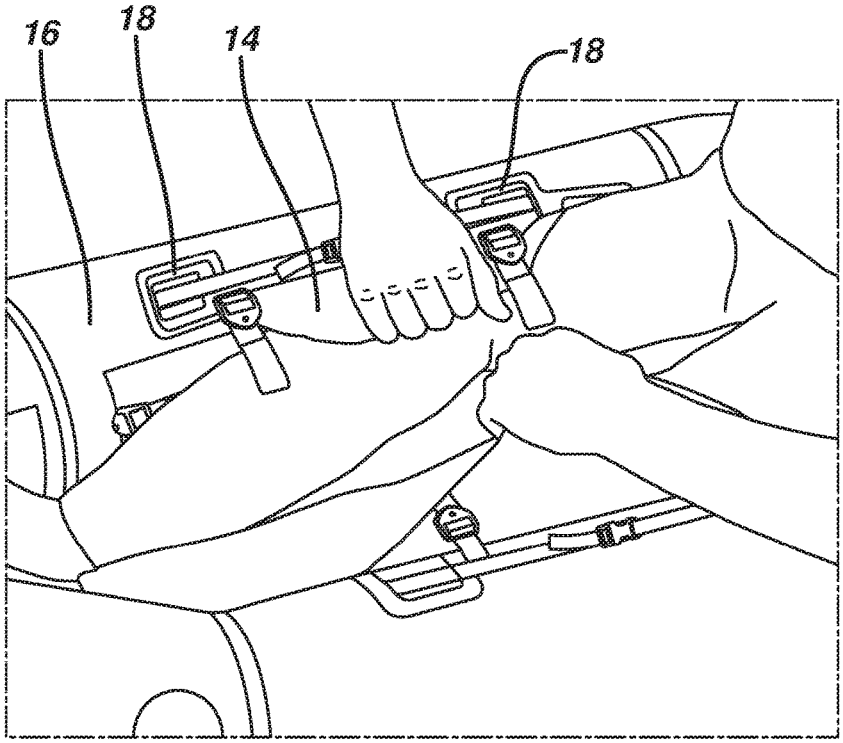
Figure 4:
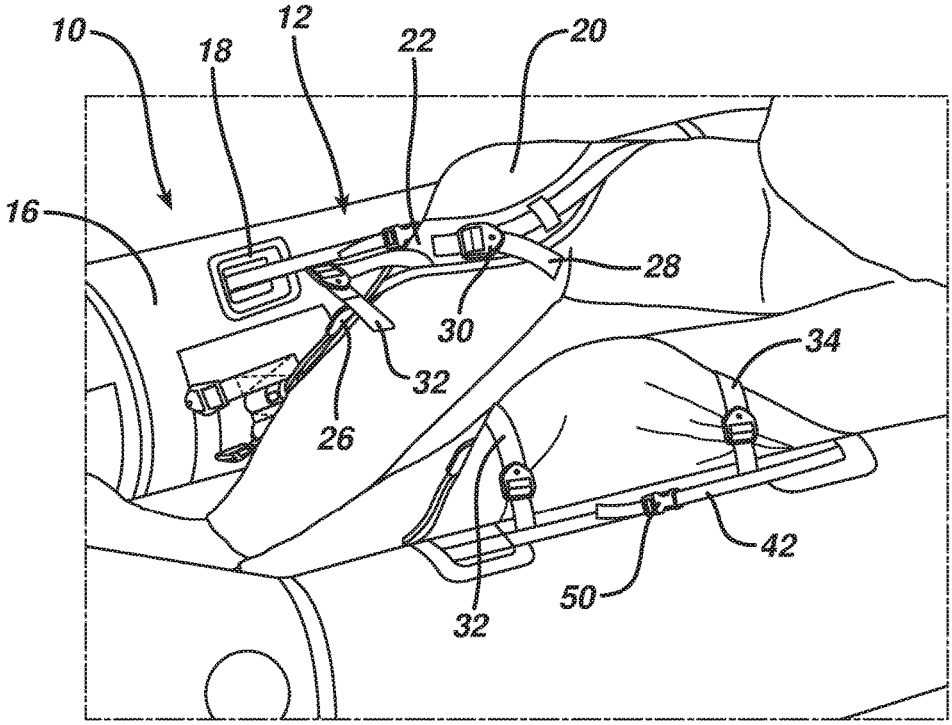

Referring to FIG. 2, the user first positions him or herself in the raft. Next, the user pulls the fabric body 14 over the knee, with the upper attachment points 18 holding the knee brace securely in place on side wall 16. The user then pushes the knee up into the fabric body 14 to seat the knee in the cup formed by the fabric body.

Figure 5:
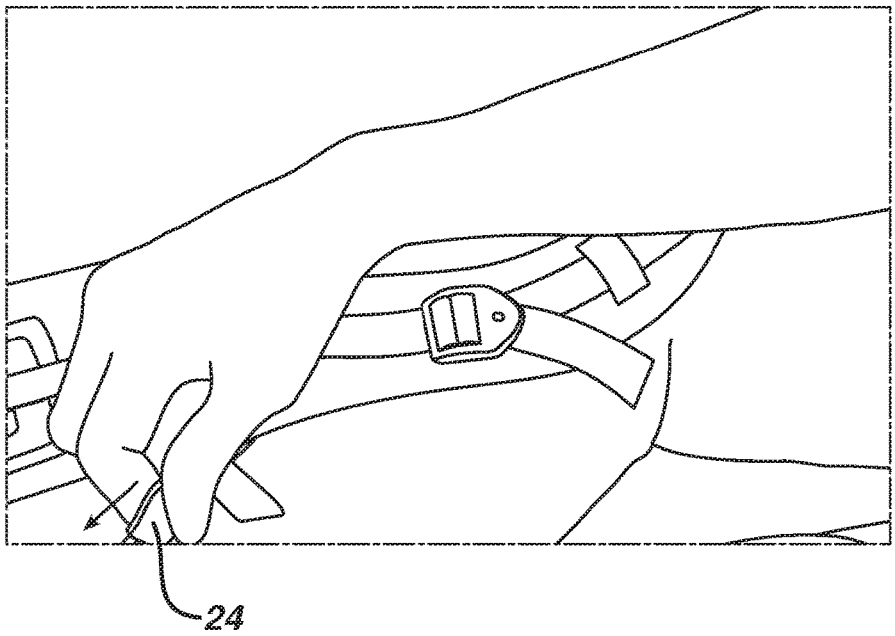

Referring now to FIG. 5, the user begins to attach the knee brace by adjusting the shin strap 24 (FIG. 8) through forward buckle 26 until the shin strap 24 is comfortably positioned on the user's shin.

Figure 6:
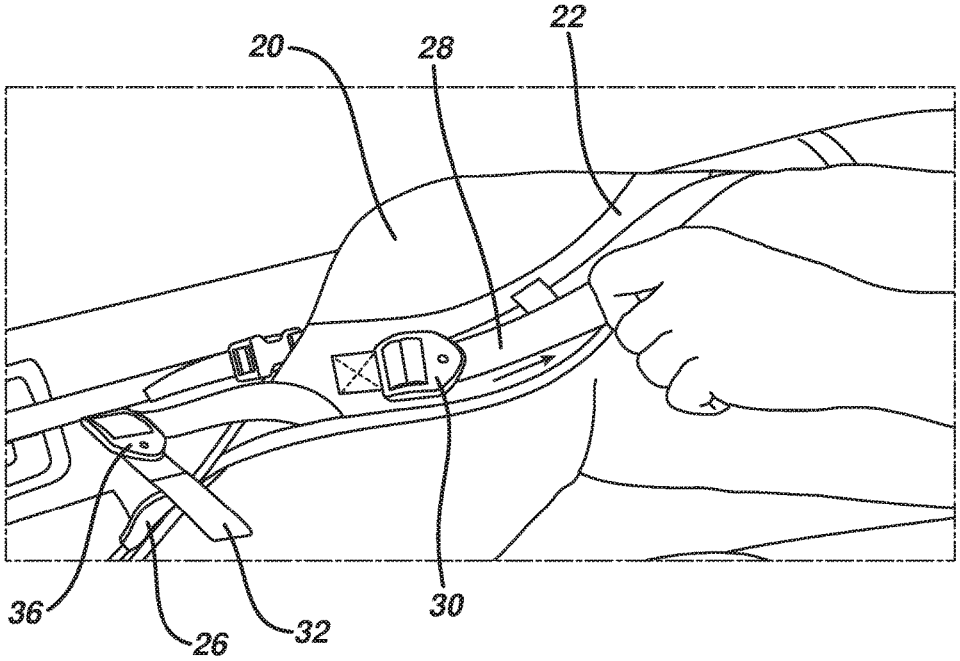

The user then adjusts central strap 28 through central buckle 30, as shown in FIG. 6, until a snug fit of the non-elastic portion 22 against the inner knee is achieved.

Figure 7:
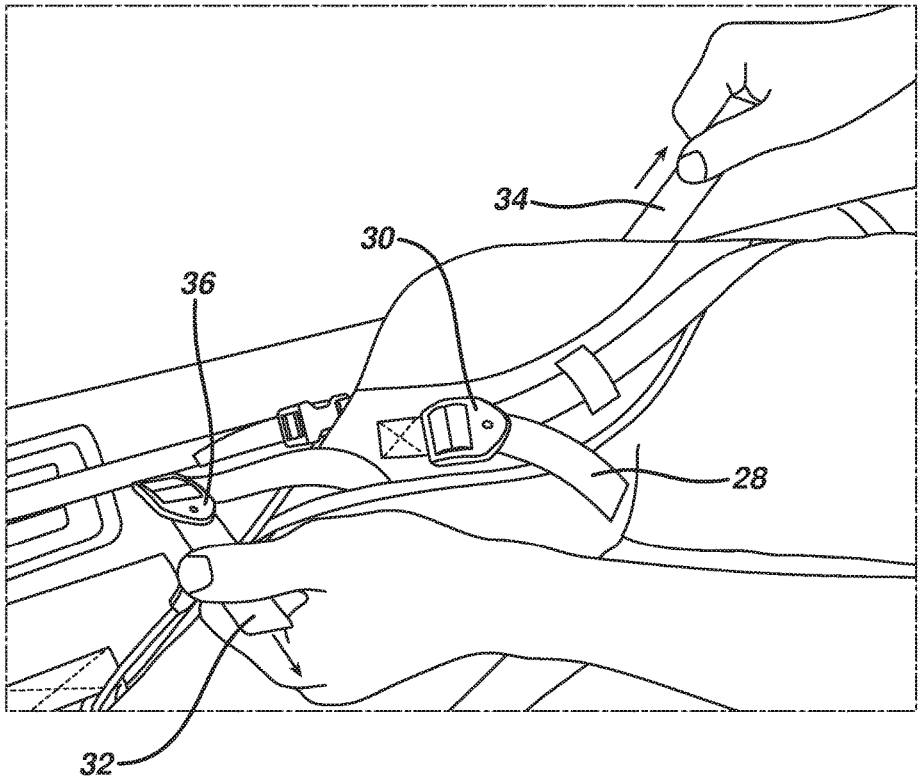

Finally, as shown in FIG. 7, the user fine tunes the adjustment of the knee brace and tightens it against the side wall 14 by adjusting side straps 32, 34, though buckles 36, 38 (FIG. 8). At this point, the user's knee is held securely in place against the side wall 16, and the user is able to apply force to the side wall through all four points of attachment. The arrangement of the straps is configured to allow the user to pull along the midline of the knee, where the most torque can be applied.

The straps may become loose during use, particularly as the webbing gets wet. The system described above allows the user to easily re-adjust the fit of the knee brace as any loosening occurs. The buckles 26, 30, 36 and 38 are also configured to allow the user to easily loosen or release the straps with one hand, e.g., by lifting up on the curved end of the buckle with the user's thumb.

A preferred sequence of steps for attaching the knee brace to the raft will now be discussed, with reference to FIGS. 9-15. It is generally preferred that this sequence of steps be performed before the raft is fully inflated, so that there is some give to side wall 16.

Figure 9:
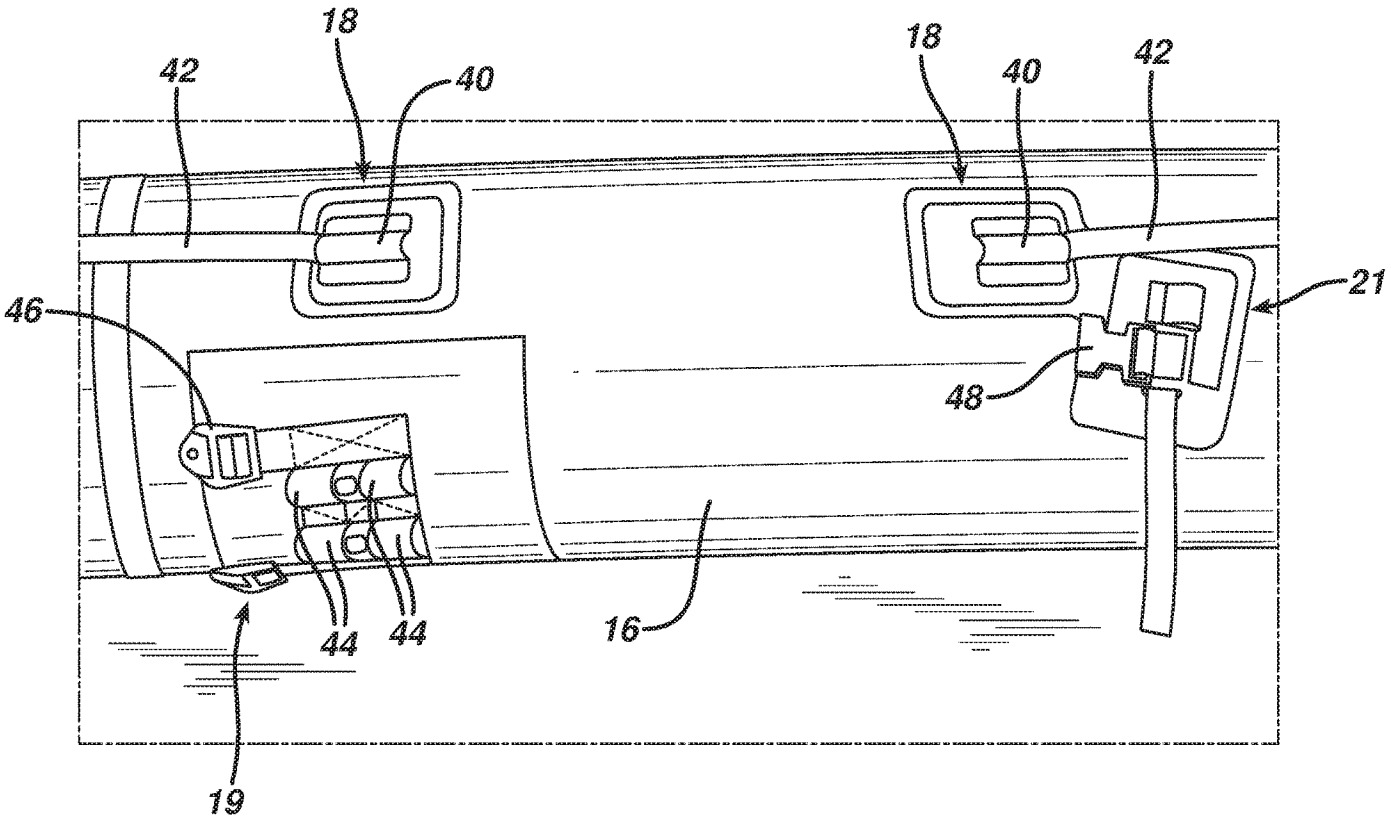
FIGS. 9-15 are detailed perspective views showing steps of attaching the knee brace to the packraft.

The installation process begins with the knee brace receiving portion of the raft in the position shown in FIG. 9. As shown in FIG. 9, the upper attachment points 18 include rod pockets 40 and securing straps 42 (which are disposed in an open position at this stage.) The forward attachment point 19 includes a plurality of attachment loops 44 and a buckle 46 to which an adjustable foot brace (not shown) can be attached. The rearward attachment point 21 includes the female buckle portion 48 of a quick release buckle. For durability, it is generally preferred that these features be mounted on reinforcing patches, as shown.

Figure 10:
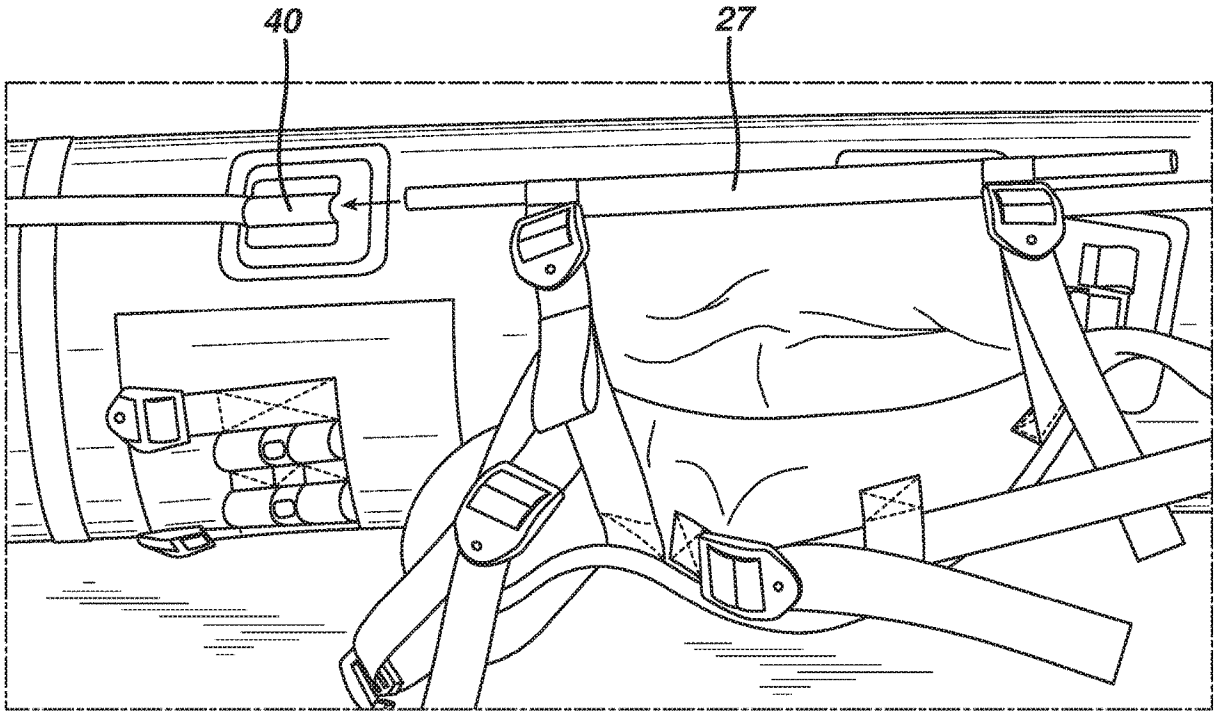
Figure 11:
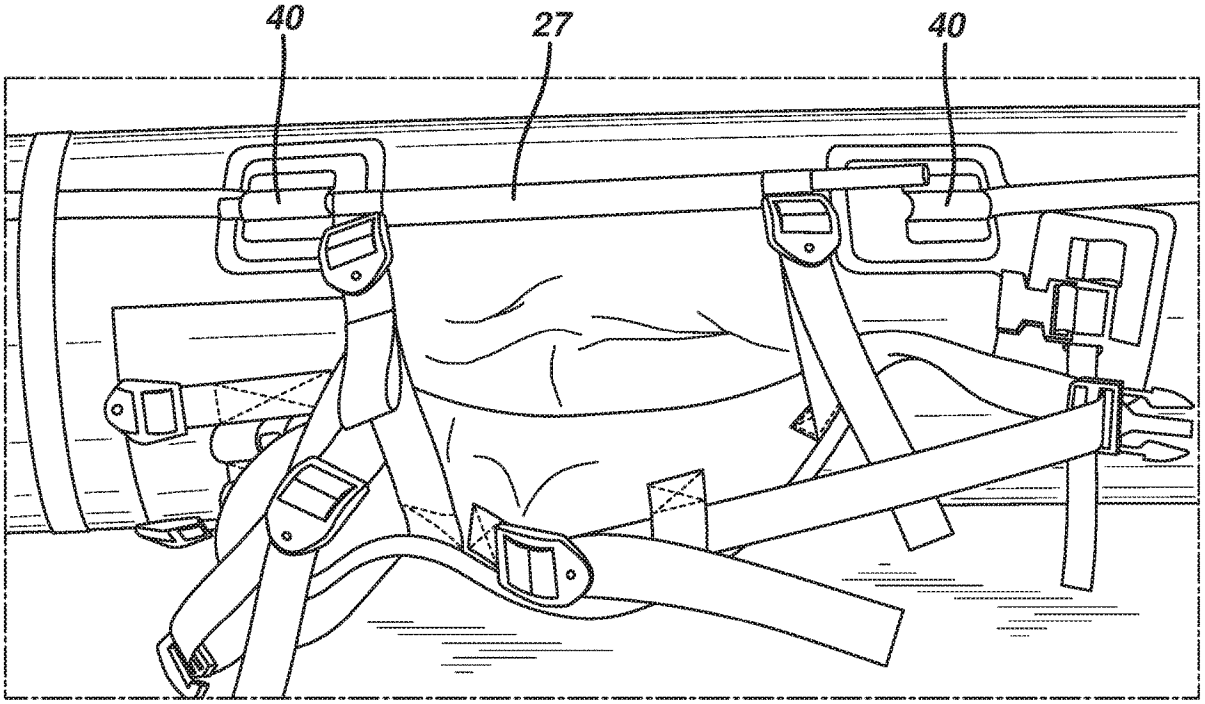
Figure 12:
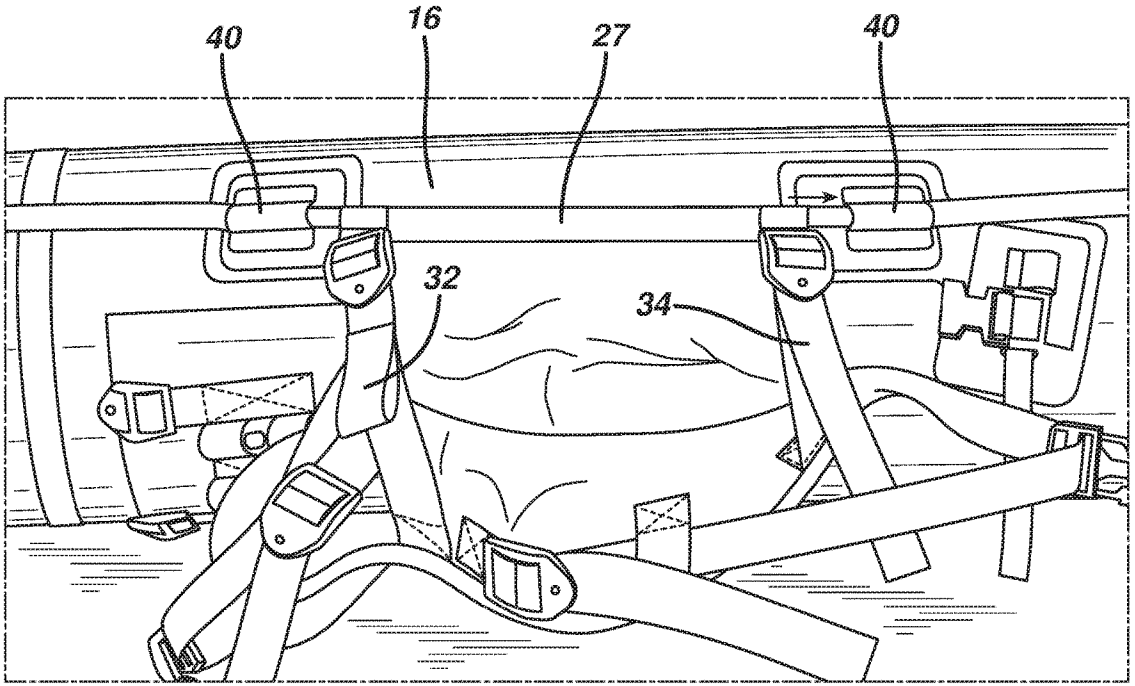

Referring now to FIGS. 10-12, the knee brace is attached first to the upper attachment points 18. To accomplish this, first one end and then the other of the rod 27 of knee brace 12 is inserted into the rod pockets 40. Because the rod 27 is formed of an inflexible material (e.g. rigid metal), this procedure is facilitated by the raft not being fully inflated. Once the ends of the rod 27 are securely positioned in the rod pockets, tension applied to the straps 32, 34 will be transferred to the rod 27 and thus to the side wall 16 through the rod pockets 40.

Figure 13:
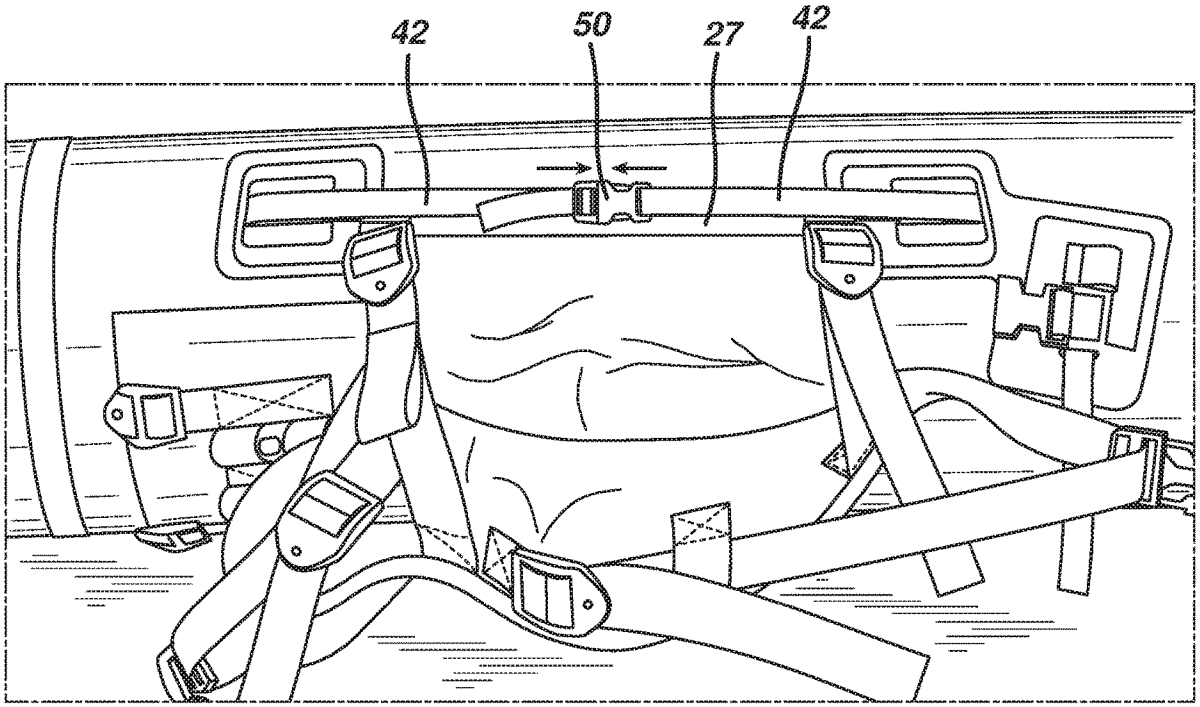
Figure 14:
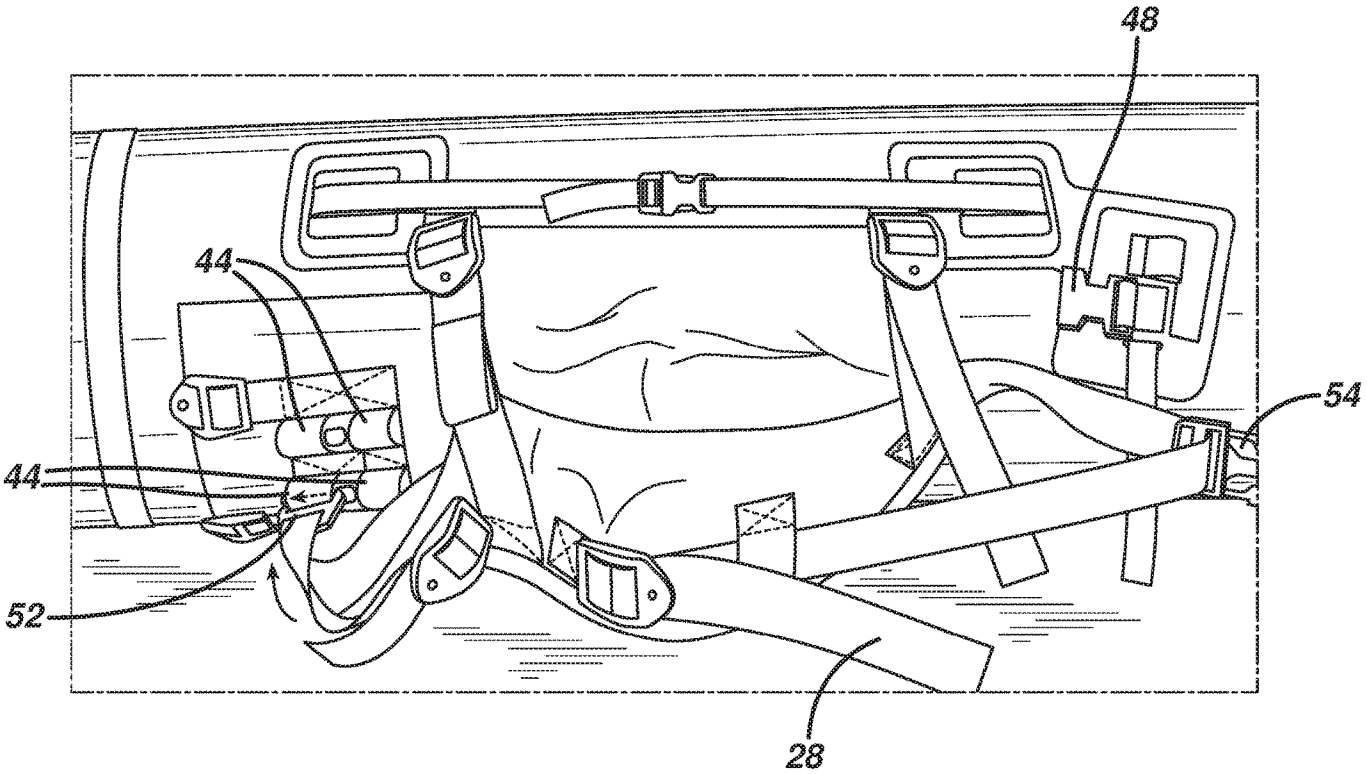

Referring now to FIG. 13, in order to ensure that the ends of rod 27 remain securely in the rod pockets 40 during use, the straps 42 are joined between the rod pockets by fastening a quick release buckle 50.

Next, the forward attachment point 19 is established by attaching a hook-type fastener 52 through one of the attachment loops 44. The attachment loop to be used is selected by the user to provide a comfortable fit on the user's leg. The strap is flipped over during attachment, as indicated by the arrows, such that the hook is inserted in a direction away from the user's torso. Flipping the strap over in this manner causes the strap 24 to extend across the user's knee with a flatter profile, enhancing user comfort.

Finally, as shown in FIG. 15, the rearward attachment point is established by attaching the central strap 28 by joining a male buckle portion 54 to female buckle portion 48.

OTHER EMBODIMENTS

A number of embodiments have been described. Nevertheless, it will be understood that various modifications may be made without departing from the spirit and scope of the disclosure.

For example, the knee brace can be attached to the packraft either removably or permanently using other techniques than that shown in FIGS. 9-15. As but a few examples, the knee brace could be permanently welded to the boat, or attached to the boat with D-rings and straps.

Moreover, the removable attachment arrangement described above may be modified, for example by providing fewer attachment loops 44 or by utilizing different types of buckles.

If desired, the protective flap 25 underlying the shin strap may be omitted.

It should also be understood that the sequences described above for applying the knee brace to the knee and attaching the knee brace to the boat are given by way of example. The steps can be performed in any desired order, and in the case of re-adjustment, may be performed individually rather than as a sequence.

Accordingly, other embodiments are within the scope of the following claims.

What is claimed is:

1. A method comprising:

securing a knee brace to a side wall of an inflatable watercraft using four releasable attachment points, each attachment point comprising a strap having a portion configured to be attached to the side wall and a free end, and adjusting the length of the free end of each strap using an adjustable fastener.

2. The method of claim 1, wherein adjusting the length of the free end of each strap causes the knee brace to apply a pulling force along the midline of a user's knee during use of the boat.

3. The method of claim 1, wherein adjusting the length of the free end of at least one of the straps comprises a user pulling the free end towards his or her torso.

4. The method of claim 1, wherein securing comprises releasably attaching a rod to the side wall by positioning ends of the rod in receiving pockets on the side wall, and suspending two of the straps from the rod.

5. The method of claim 1, wherein the knee brace defines an enclosed cup surrounding a user's knee.

6. The method of claim 1, wherein securing comprises releasably attaching a clip on one of the straps to one of an array of attachment loops on the side wall.

* * * * *